US005494022A

United States Patent [19]

Sung

[11] Patent Number: 5,494,022

[45] Date of Patent: Feb. 27, 1996

[54] BALL PROJECTING APPARATUS

[75] Inventor: Lan-Chung Sung, Taichung Hsien, Taiwan

[73] Assignee: Right Way Co., Taiwan

[21] Appl. No.: 264,511

[22] Filed: Jun. 23, 1994

[51] Int. Cl.[6] ..... A63B 69/38; A63B 69/40; F41B 7/00

[52] U.S. Cl. ..... 124/16; 124/7; 124/1; 273/26 D

[58] Field of Search ..... 124/54, 16, 7; 223/29 A, 26 D

[56] References Cited

U.S. PATENT DOCUMENTS 1,051,470 1/1913 Waldman ..... 124/7
4,368,885 1/1983 Katada et al. ..... 124/16 X
4,615,325 10/1986 Yamamura et al. ..... 124/7
4,772,017 9/1988 Eriksen ..... 124/1 X

*Primary Examiner*—Anthony Knight
*Attorney, Agent, or Firm*—Cushman Darby & Cushman

[57] ABSTRACT

A ball projecting apparatus includes a housing with a frontward opening. The interior of the housing has an elongated ball guider which extends inclinedly and longitudinally from a position near the frontward opening and which terminates at a lower position, an electrically driven rotor which is mounted below the elongated ball guider, and a torsion spring which is mounted pivotally to the housing. The torsion spring has a first end portion which engages by a stopper and a second end portion which extends into a circular path that is traveled by the rotor when the rotor is activated.

11 Claims, 10 Drawing Sheets

BALL PROJECTING APPARATUS

BACKGROUND OF THE INVENTION

1. Field of the Invention

The invention relates to a ball projecting apparatus, more particularly to a ball projecting apparatus which enables a player to improve his hitting efficiency.

2. Description of the Related Art

Referring to FIGS. 1 and 2, a conventional ball projecting apparatus 1 is shown to comprise a ball impelling tube 14 which receives randomly a ball from a ball storing body 11 at pre-arranged intervals and a pneumatically operated piston assembly 13 which is communicated with the ball impelling tube 14 and which projects the ball out from the impelling tube 14 upon operation of the projecting apparatus 1.

Some of the drawbacks associated with the conventional ball projecting apparatus 1 are as follows:

(I) An external power source 19 is required to operate a pump 18 of the ball projecting apparatus 1, thereby hindering the use of the apparatus 1 in open fields where electricity is not easily available.

(II) The conventional ball projecting apparatus 1 comprises a support stand 15 for mounting the ball impelling tube 14, a ball storing body 11 mounted above and communicated with the impelling tube 14, a piston assembly 13 mounted to the impelling tube 14 for projecting a ball therefrom, a pump 18 with a plurality of control valves 17, and a plurality of connecting pipes 16 which interconnect the pump 18 to the piston assembly 13. Due to the large number of components involved, it takes a longer time to assemble the conventional projecting apparatus 1, thus increasing correspondingly the manufacturing expense thereof.

(III) The conventional ball projecting apparatus 1 is bulky and cannot be stored and transported conveniently.

FIG. 3 illustrates a portable ball projecting apparatus 3 which can overcome most of the above-mentioned drawbacks. As illustrated, the conventional ball projecting apparatus 3 comprises a casing 31 which has an upper section with a ball inlet 35 and a front section with a ball outlet 36. The casing 31 further has an electrically operated roller 32 and a curved plate 34 therein. The curved plate 34 and an external surface of the roller 32 cooperate to define a ball traveling path 341 therebetween. The path 341 has a width (H) that is slightly smaller than the diameter of the ball 2. When the ball 2 is fed into the traveling path 341 and the roller 32 is driven in an anti-clockwise direction, friction among the roller 32, the ball 2 and the curved plate 34 causes the projection of the ball 2 out of the casing 31 via the outlet 36.

Some of the drawbacks that result of the conventional projecting apparatus are as follows:

(I) Though the conventional projecting apparatus 3 is portable, it is still inconvenient to use in the open fields, where electricity is not easily available. The conventional projecting apparatus 3 requires ac power to operate the motor 33 so as to drive the roller 32 in order to generate a force sufficient to impel the ball passing through the path 341 and flying out therefrom.

(II) The width of the ball traveling path 341 is not adjustable so that it can accommodate only a ball with a particular size, thereby limiting the use thereof.

SUMMARY OF THE INVENTION

A main objective of the present invention is to provide a portable ball projecting apparatus which can project a ball of different sizes.

A second objective of the present invention is to provide a ball projecting apparatus which has ball impelling mechanism that can be operated by DC power to permit the use of the apparatus in open field where electric outlets are usually unavailable.

A third objective of the present invention is to provide a ball projecting apparatus which can be easily assembled so as to reduce the time that is required to assemble the apparatus and the manufacturing expense.

Accordingly, a ball projecting apparatus of the present invention includes a housing with a frontward opening and which has an elongated ball guider, an electrically driven rotor and a torsion spring therein. The elongated ball guider is provided with a longitudinal slot and extends inclinedly and longitudinally from a position near the frontward opening to a lower position of the housing. The rotor is mounted below the elongated ball guider and has at least one lobe with a free end. The free end revolves with the lobe along a circular path when the rotor is driven electrically. The torsion spring is mounted pivotally in the housing and has a first end engaging by a stopper and a second end portion extending into the circular path via the longitudinal slot. Thus, a ball that was fed into the elongated ball guider of the housing can be projected exteriorly of the latter via the frontward opening when the torsion spring is triggered by the rotation of the rotor.

The housing further has means for sensing the ball in the ball guider in order to initiate the rotor, and a shock absorber between the elongated ball guider and the rotor. The shock absorber abuts the second end portion of the torsion spring at the normal condition.

In the disclosed embodiment, the housing comprises two halves, and the elongated ball guider comprises a first longitudinal plate with an inclined top face and which is integral with one of the halves and a second longitudinal plate which is mounted pivotally on the other one of the halves. The first and second longitudinal plates have separate longitudinal edges and cooperatively define the above-mentioned longitudinal slot therebetween. The sensing means includes a switch mounted below the second longitudinal plate and connected electrically to the rotor. The switch has an actuating rod which bears on the second plate during the normal condition and which actuates the rotor upon being depressed by pressure of the ball that is disposed on the second plate.

The housing preferably has an upward opening at a top section above the elongated ball guider, a fixed shaft for holding pivotally the torsion spring, and a guiding path below the fixed shaft and formed cooperatively by inner surfaces of the two halves for receiving the stopper therein. A battery chamber is formed below the guiding path. Movement of the stopper along the guiding path due to actuation of the regulating screw member can alter the elastic characteristics of the torsion spring.

In use, a funnel-shaped net with a bottom opening can be stretched above the housing in such a manner that the bottom opening of funnel-shaped net is disposed above the upward opening of the housing. Thus, player can strike an advancing ball toward the funnel-shaped net so as to improve his ball hitting efficiency.

The two halves which form the housing can be easily produced in a known manner, and the assembly of the torsion spring and the rotor in the housing can be done with little inconvenience. Thus, the production time and manufacturing expense incurred are less than those incurred in the production of the previously mentioned conventional projecting apparatuses.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENTS

Figure 1:
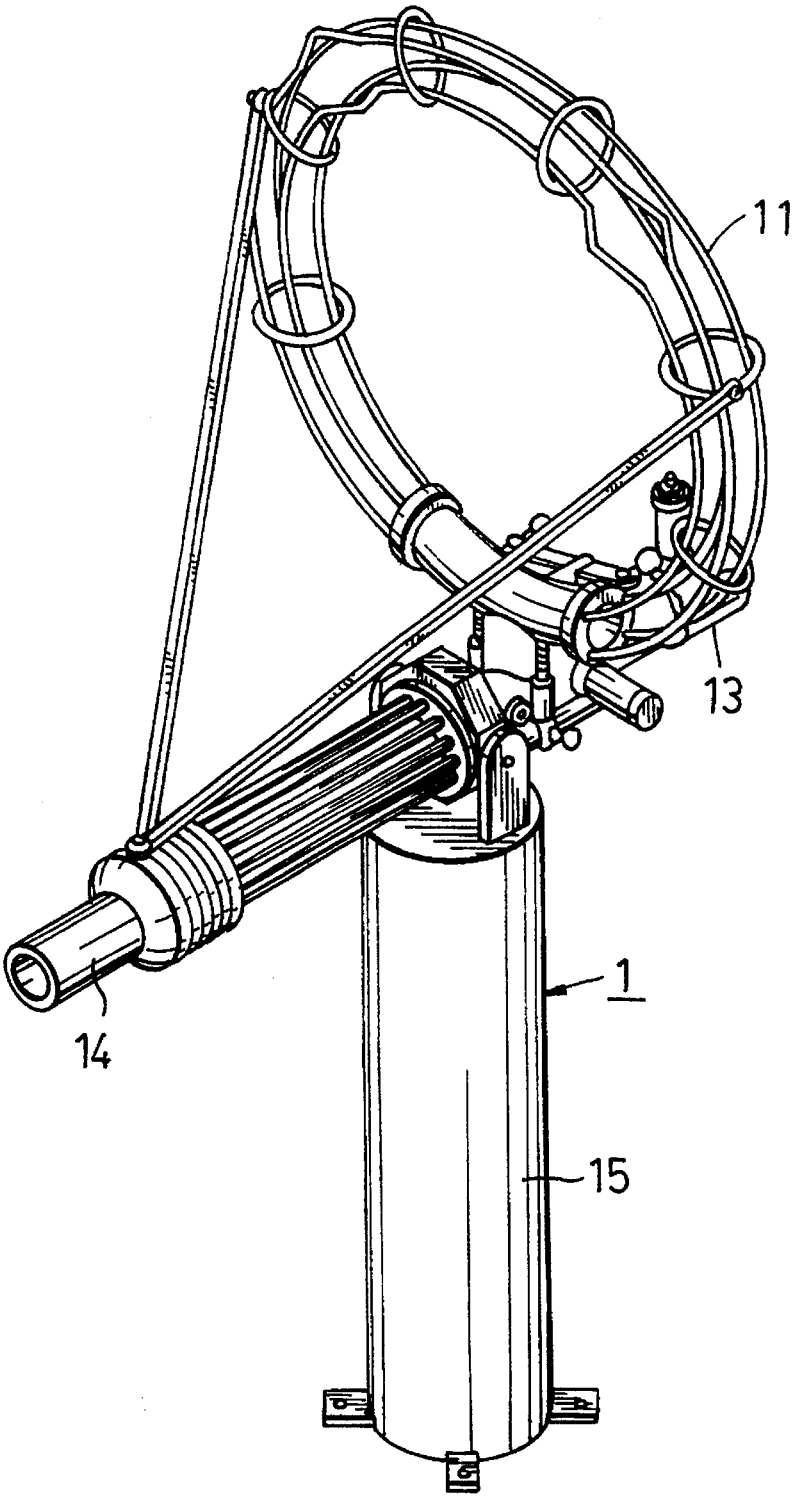
FIG.1 PRIOR ART
FIG. 1 is a perspective, schematic view of a pneumatically operated conventional ball projecting apparatus.
Figure 2:
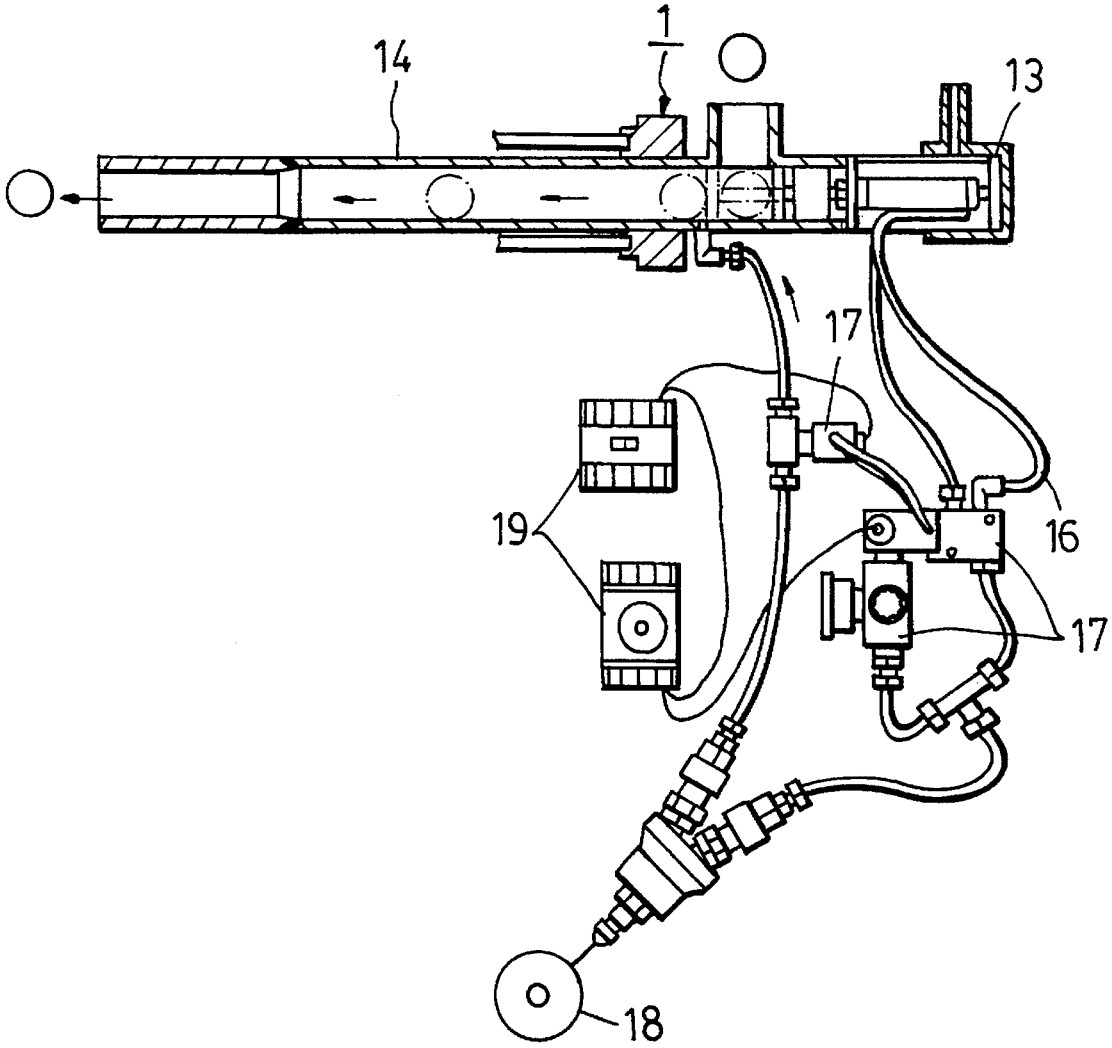
FIG.2 PRIOR ART
FIG. 2 shows the operation of the pneumatic conventional ball projecting apparatus of FIG. 1, a ball storing tube and a support stand are removed in order to illustrate the various connections.
Figure 3:
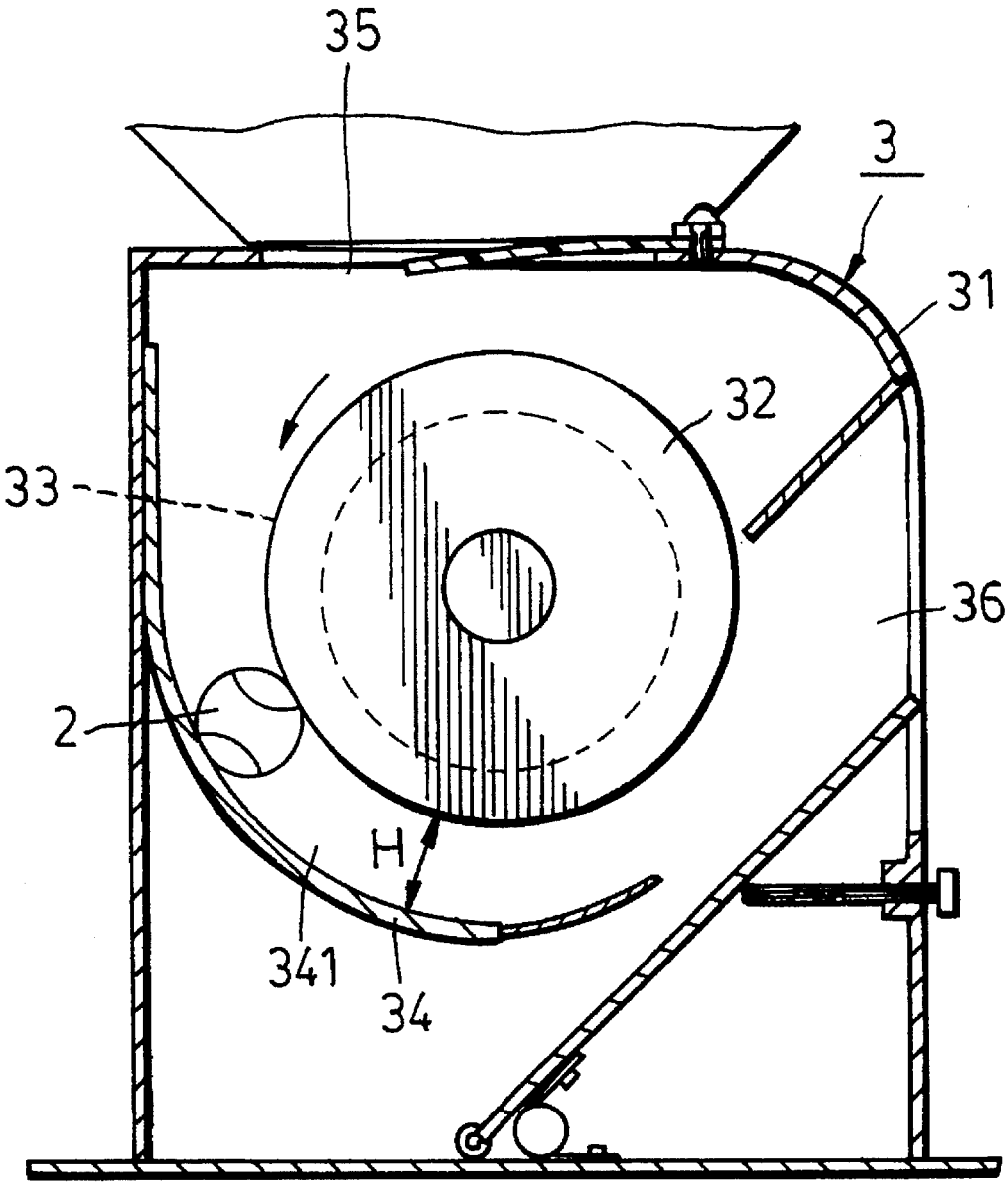
FIG.3 PRIOR ART
FIG. 3 shows a cross sectional view of a portable conventional ball projecting apparatus.
Figure 4:
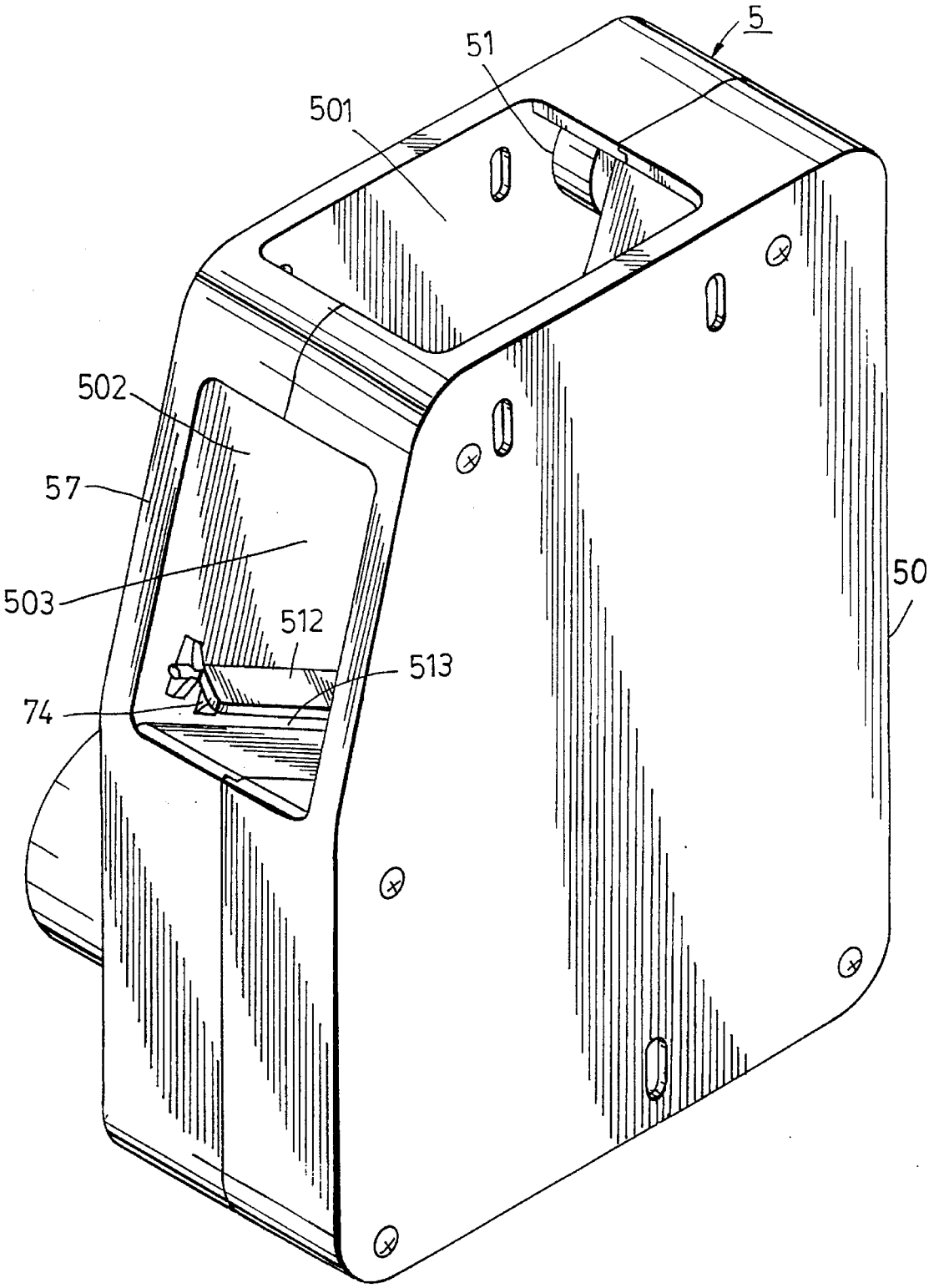
FIG. 4 is a perspective, schematic view of a ball projecting apparatus of the present invention.
Figure 5:
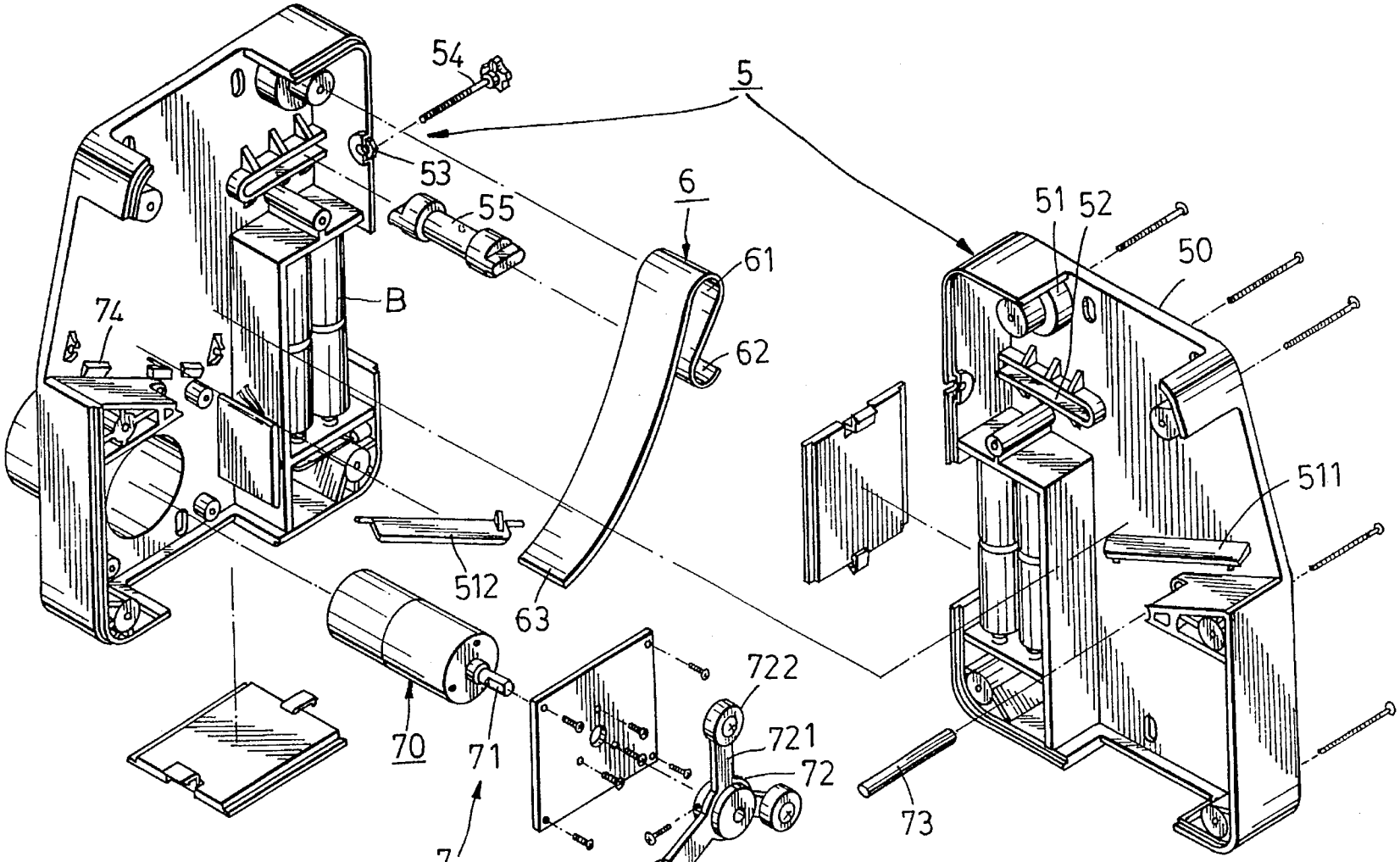
FIG. 5 is an exploded view of the ball projecting apparatus of the present invention.
Figure 6:
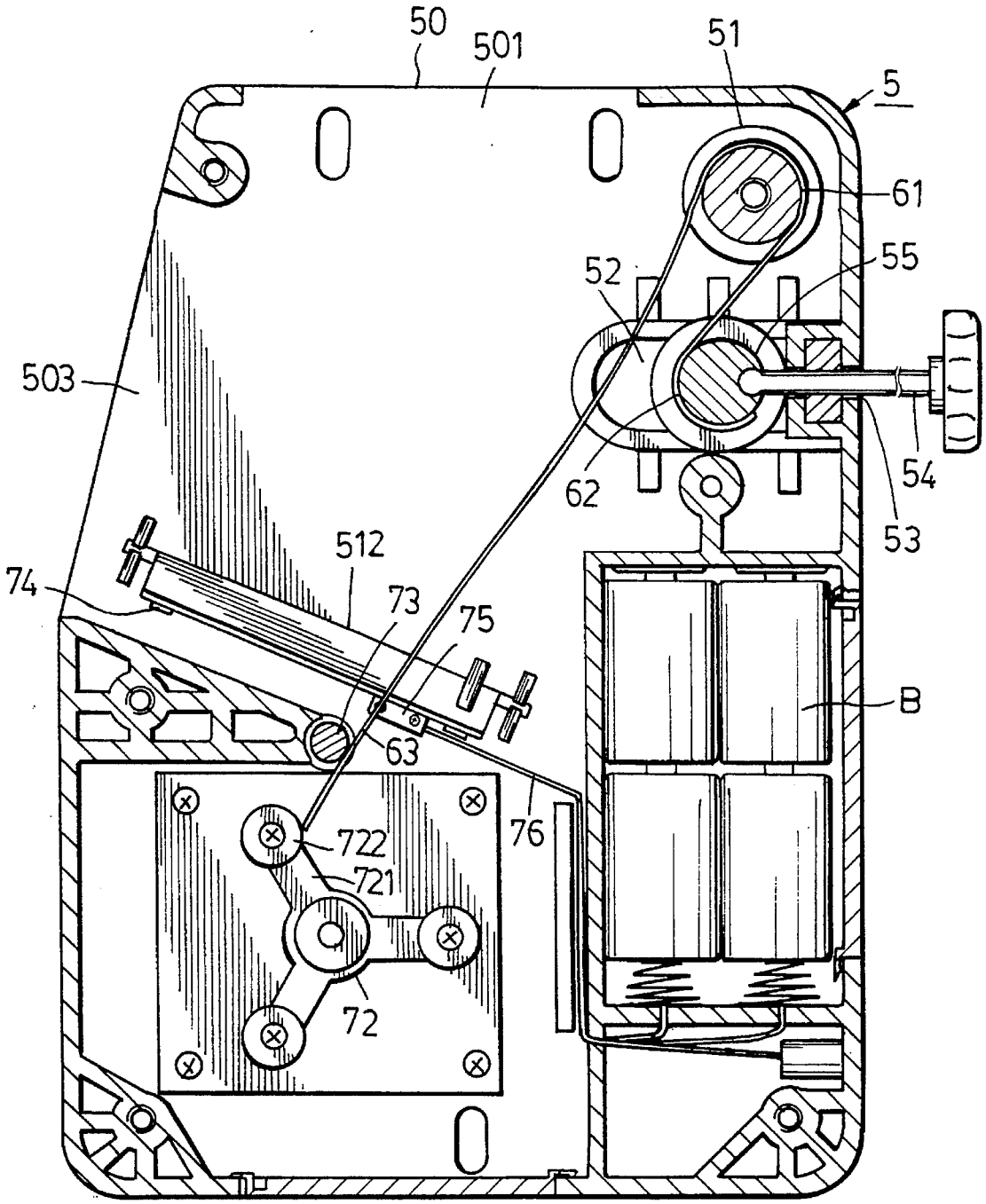
FIG. 6 is a cross sectional view which illustrates the assembly of the ball projecting apparatus shown in FIG. 4.

Referring to FIGS. 4, 5 and 6, a ball projecting apparatus according to the present invention is shown to comprise a housing 5 which is formed by two halves 50. The halves 50 are produced separately in a known manner and are combined to one another by a suitable mounting means to form the housing 5. The housing 5 has a peripheral wall which is formed by the peripheries of the combined halves 50. The peripheral wall has a top section which is provided with an upward opening 501 for feeding a ball into the housing 5, a front section and an inclined section 57 which extends between the front and top sections. The housing 5 is provided with a frontward opening 502 which is formed through the inclined section 57 for projecting of the balls therefrom.

The housing 5 has an elongated ball guider 503 which is formed cooperatively by a first longitudinal plate 511 with an inclined top face that is integral with one of the halves 50, and a second longitudinal plate 512 which is mounted inclinedly and pivotally on the other one of the halves 50. The inclined top faces of the first and second longitudinal 511, 512 cooperatively define a longitudinal slot therebetween. The elongated ball guider 503 extends inclinedly and longitudinally from the frontward opening 502 and terminates at a lower position interiorly of the housing 5. The elongated ball guider 503 is below the upward opening 501. Each of the first and second longitudinal plates 511, 512 has a peripheral edge which cooperates with the peripheral edge of the other one of the longitudinal plates 511, 512 to define a clearance 513 therebetween, the purpose of which will be disclosed in the following paragraphs. The clearance 513 is communicated with the longitudinal slot.

An electrically driven rotor 7 is mounted within the housing 5 below the elongated ball guider 503 and includes a motor 70 with a driving shaft 71 and a rotatable unit 72 mounted securely on the driving shaft 71. The rotatable unit 72 has three lobes 721, each with a roller 722 at its free end. The rollers 722 revolve along a circular path when the motor 70 is driven electrically.

A shock absorber 73, generally made from rubber to retard vibration, is mounted adjacent to the terminal end of the ball guider 503 between the elongated ball guider 503 and the rotor 7.

The housing 5 further has a fixed shaft 51 which extends between the two halves 50 adjacent to the upward opening 501 and a guiding path 52 which is disposed below the fixed shaft 51 and which is formed cooperatively by inner surfaces of the two halves 50. A stopper 55 is disposed transversely in the guiding path 52. A regulating screw member 54 can be inserted into the guiding path 52 so as to connect with the stopper 55. A battery chamber (B) is formed below the guiding path 52 for receiving battery cells therein.

Figure 9:
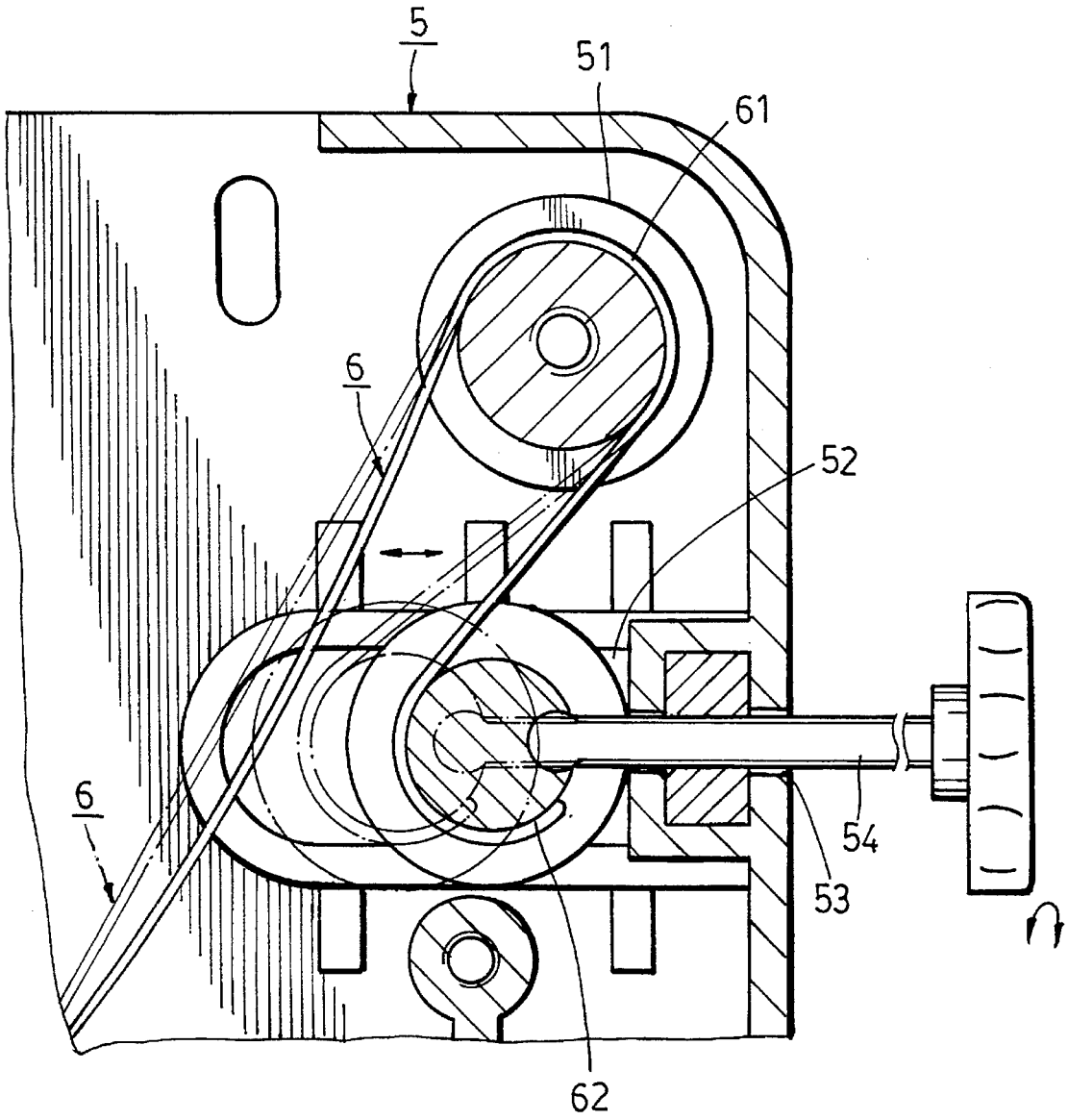
FIG. 9 illustrates how a spring-holding stopper employed in the ball projecting apparatus of the present invention is regulated from an exterior of the same to alter the elastic properties of a spring.

A torsion spring 6 has a curved portion 61 mounted pivotally by the fixed shaft 51 in the housing 5, a first end portion 62 engaging by the stopper 55 and a second end portion 63 extending the stopper downwardly into the circular path of the rollers 722 via the longitudinal slot of the ball guider 503 so that the second end portion 63 of the torsion spring 6 abuts the shock absorber 73 during the normal condition, as shown in FIG. 6. Note that actuation of the regulating screw 54 changes selectively the position of the stopper 55 along the guiding path 52 to alter correspondingly the elastic properties of the torsion spring 6, as illustrated in FIG. 9.

Figure 7:
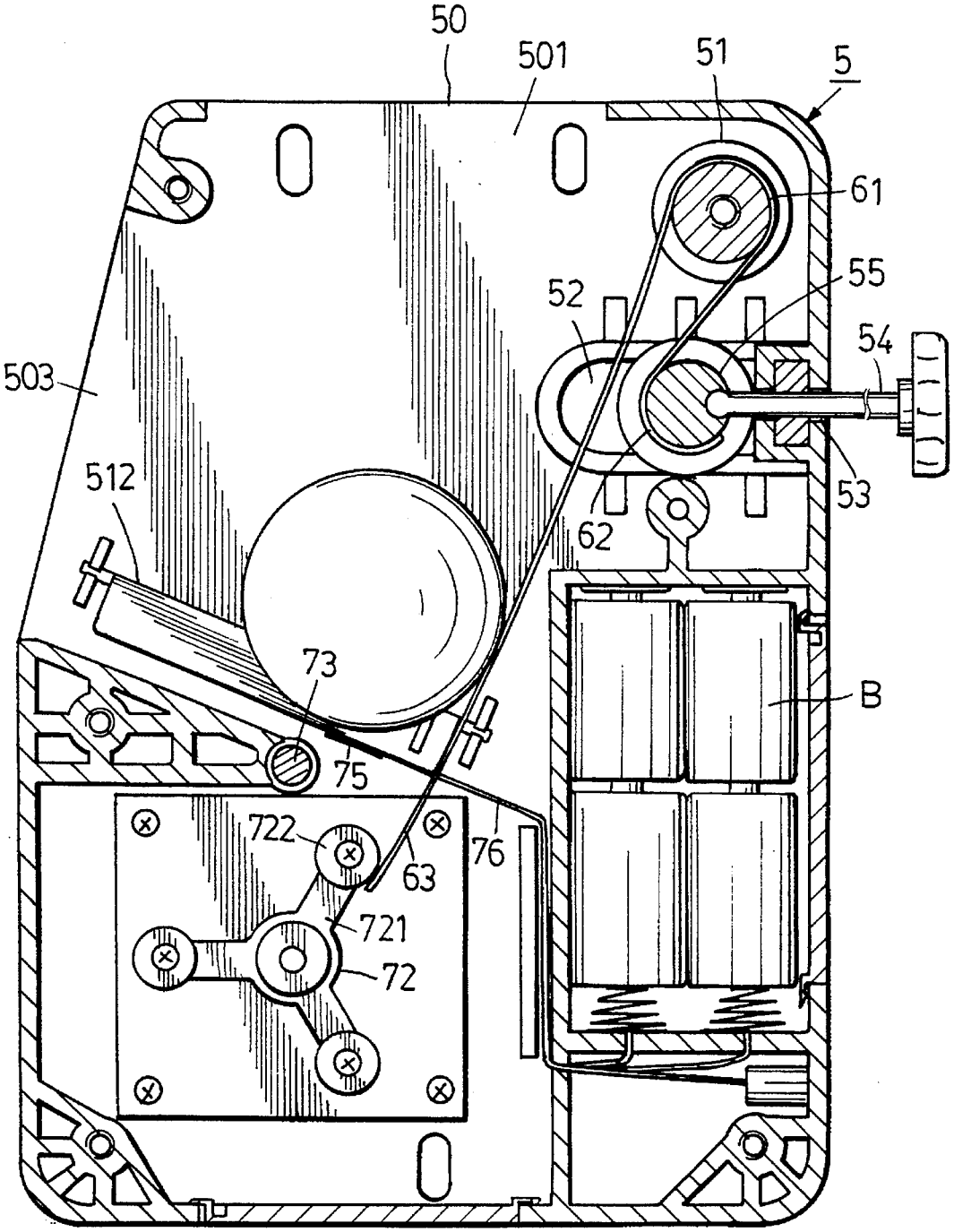
FIG. 7 shows a cross sectional view of the ball projecting apparatus of the present invention when a ball is fed therein.

Referring to FIG. 7, the housing 5 further comprises means for sensing a ball that was fed into the elongated ball guider 503. The sensing means includes a switch 74 which is provided below the second longitudinal plate 512 and which is connected electrically to the motor 70 and the battery cells by wire means 76, and an actuating rod 75 which bears against the second longitudinal plate 512 during normal conditions.

Figure 8:
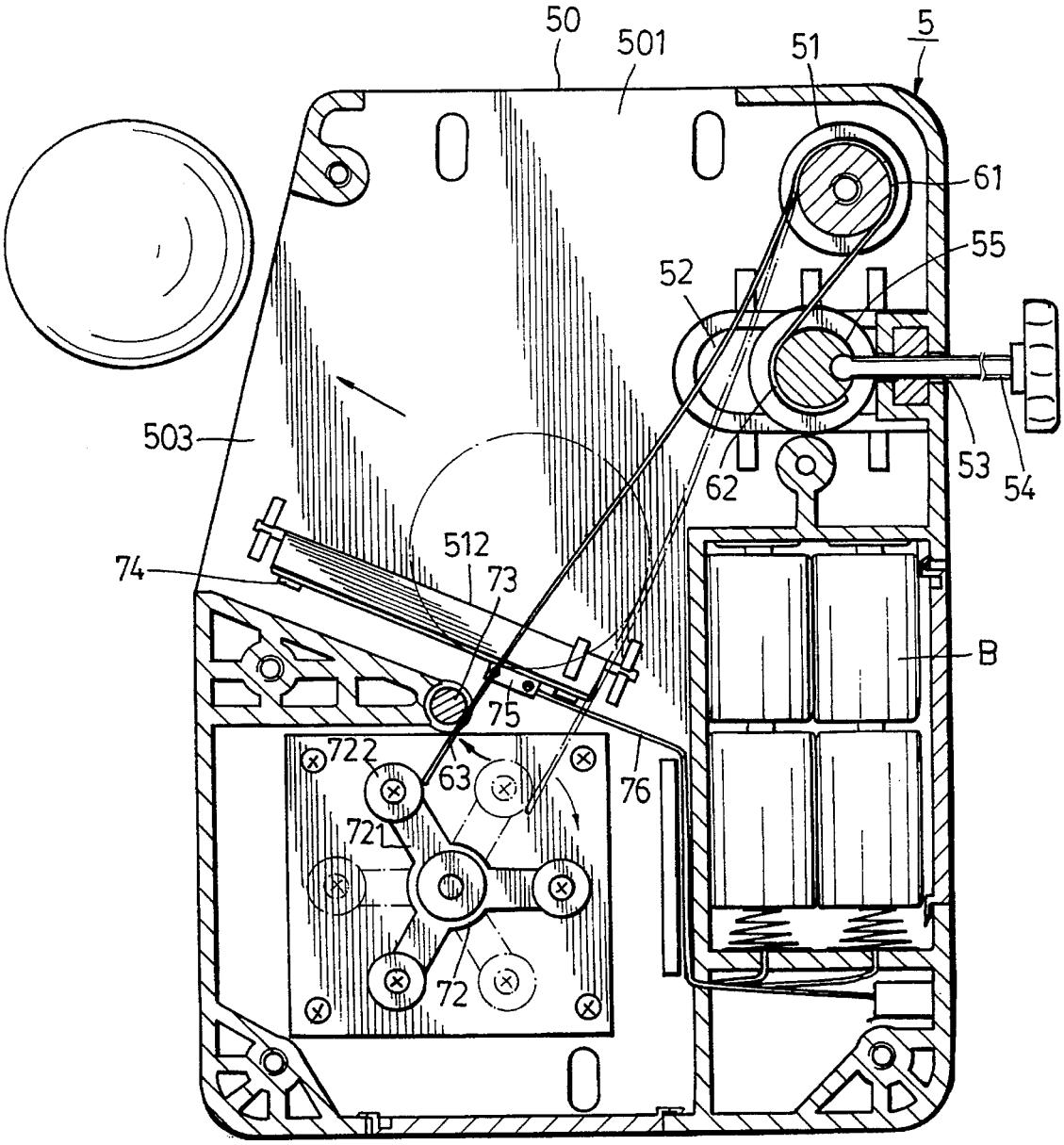
FIG. 8 illustrates how the ball is projected by the ball projecting apparatus of the present invention.

Referring to FIG. 8, when a ball is fed into the elongated ball guider 503 from the inlet 501, the second longitudinal plate 512 is depressed by the weight of the ball which depresses consequently the actuating rod 75 so that the switch 74 is activated. The motor 70 rotates in a clockwise direction, and the second end portion 63 of the torsion spring 6 is depressed rearwardly by the roller 722 which disengages from the former after a short period of rotation. Thus, the ball is projected by the second end portion 63 of the torsion spring 6 to fly out of the housing 5 via the frontward opening 502. Once the ball has been projected from the housing 5, the second longitudinal plate 512 ceases to be depressed and the switch 74 is deactivated. The motor 70 is correspondingly deactivated.

Figure 10:
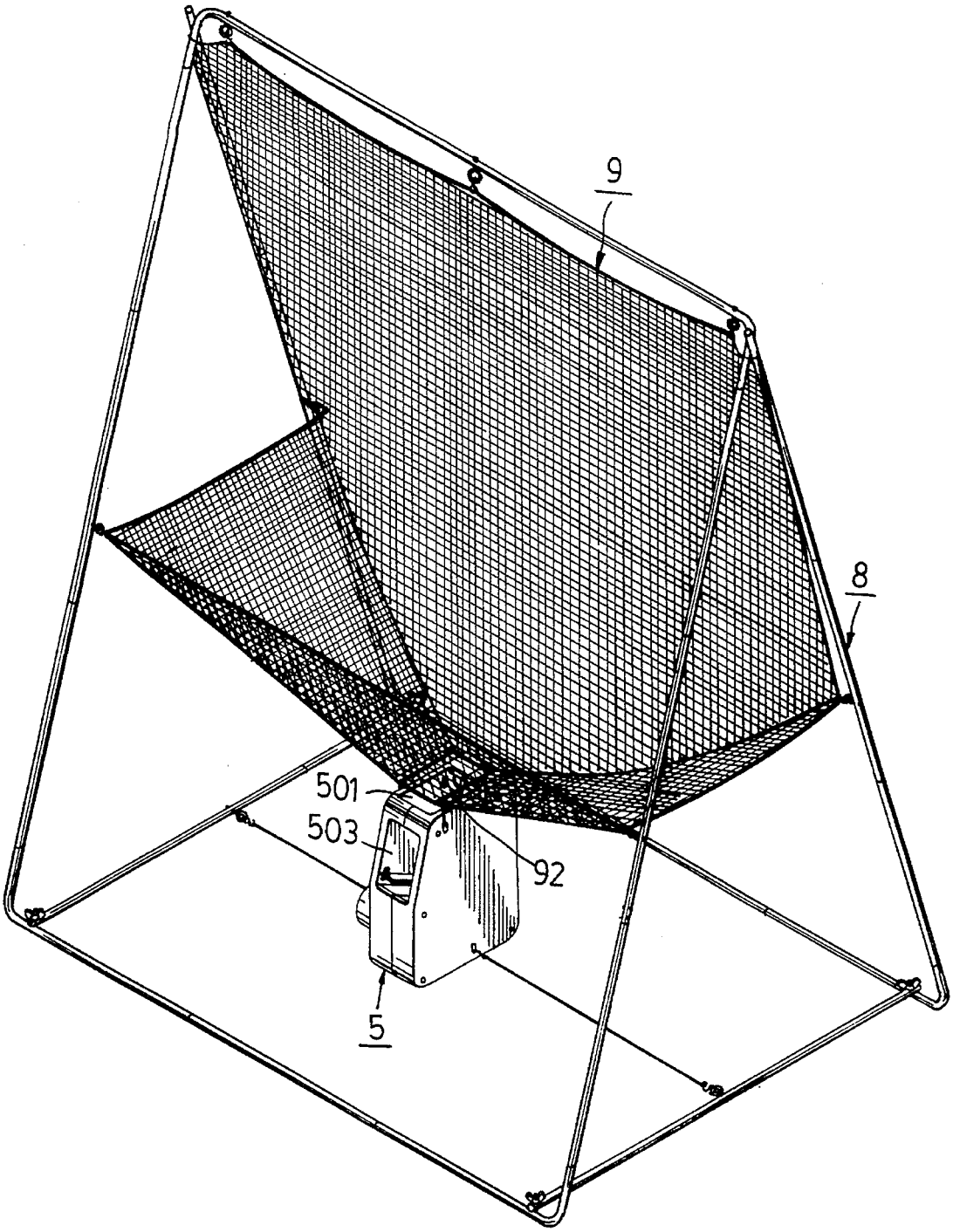
FIG. 10 shows the projecting apparatus of the present invention when used in conjunction with a funnel-shaped net.

Referring to FIG. 10, the ball projecting apparatus of the present invention can be used to enable a player to improve his hitting efficiency. A funnel-shaped net 9 with a bottom opening 92 can be stretched above the housing 5 by the use of a suspension frame 8 such that the upward opening 501 of the housing 5 is in communication with a bottom opening 92 of the net 9. The player can strike the advancing ball by aiming at the funnel-shaped net 9. The ball will fall back into the ball projecting apparatus of the present invention if it hits the funnel-shaped net 9.

The apparatus is compact so that it can be transported to a desired location. AC current is not required to drive the rotor 7. The assembly of the rotor 7 and the first and second longitudinal plates 511, 512 to the halves 50 can be done easily before the halves 50 are combined to form the housing 5. Since the ball guider 503 of the housing 5 is adapted to receive balls of different sizes, the apparatus of the present invention can be used to train for different games, such as tennis, baseball, etc.

While a preferred embodiment has been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A ball projecting apparatus comprising:

a housing with a frontward opening;

an elongated ball guider provided in said housing having a longitudinal slot formed therealong, said elongated ball guider extending inclinedly and longitudinally from a position near said frontward opening to a lower position of said housing;

an electrically driven rotor mounted in said housing below said elongated ball guider, said rotor having at least one lobe with a free end, said free end revolving with said lobe along a circular path when said rotor is driven;

a torsion spring mounted pivotally in said housing, said torsion spring having a first end portion and a second end portion opposite to said first end portion extending into said circular path via said longitudinal slot;

stopper disposed in said housing and engaging said first end portion of said torsion spring; and means for sensing said ball in said elongated ball guider to drive said rotor, wherein, said torsion spring can be triggered by said rotor to project a ball in said elongated ball guider out of said housing via said frontward opening.

2. The ball projecting apparatus as in claim 1, further comprising a shock absorber mounted between said elongated ball guider and said rotor, said shock absorber abutting said second end portion of said torsion spring.

3. The ball projecting apparatus as in claim 2, wherein said shock absorber is made of rubber.

4. The ball projecting apparatus as in claim 1, further comprising means for regulating said stopper to vary position of said stopper in said housing to correspondingly alter elastic characteristics of said torsion spring.

5. The ball projecting apparatus as in claim 4, wherein said housing has a fixed shaft extending between two halves at a top section for holding pivotally said torsion spring, said two halves of said housing having inner surfaces which cooperatively define a guiding path below fixed shaft for receiving said stopper.

6. The ball projecting apparatus as in claim 2, wherein each said lobe has a roller mounted rotatably at said free end.

7. A ball projecting apparatus comprising:

a housing with a frontward opening and first and second halves;

an elongated ball guider provided in said housing having first and second longitudinal plates which cooperatively form a longitudinal slot formed therebetween, said first longitudinal plate being integral with said first half of said housing, said second longitudinal plate being mounted pivotally on said second half of said housing, said elongated ball guider extending inclinedly and longitudinally from a position near said frontward opening to a lower position of said housing;

an electrically driven rotor mounted in said housing below said elongated ball guider, said rotor having at least one lobe with a free end, said free end revolving with said lobe along a circular path when said rotor is driven;

a torsion spring mounted pivotally in said housing, said torsion spring having a first end portion and a second end portion opposite to said first end portion extending into said circular path via said longitudinal slot, wherein said torsion spring can be triggered by said rotor to project a ball in said elongated ball guider out of said housing via said frontward opening;

a stopper disposed in said housing and engaging said first end portion of said torsion spring; and a switch below said second longitudinal plate and electrically connected to said rotor, said switch having an actuating rod which bears against said second longitudinal plate and which enables said rotor to operate when said second longitudinal plate is depressed by said ball disposed thereon to further depress said actuating rod.

8. The ball projecting apparatus as in claim 7, wherein said housing has a peripheral wall which is formed by peripheries of said first and second halves, said peripheral wall having a top section, a front section, and an inclined section extending between said top and front sections, said frontward opening being formed through said inclined section.

9. The ball projecting apparatus as in claim 8, wherein said housing has an upward opening formed through said top section above said elongated ball guider.

10. The ball projecting apparatus as in claim 9, further comprising a funnel-shaped net stretched above said housing, said funnel-shaped net having a bottom opening disposed above said upward opening of said housing.

11. The ball projecting apparatus as in claim 7, wherein said rotor has a motor and said housing further comprises a battery chamber to receive battery cells for supplying power to said motor.

* * * * *